US009761242B2

(12) United States Patent
Tu et al.

(10) Patent No.: US 9,761,242 B2
(45) Date of Patent: Sep. 12, 2017

(54) VOICE SIGNAL PROCESSING APPARATUS AND VOICE SIGNAL PROCESSING METHOD

(71) Applicant: Acer Incorporated, New Taipei (TW)

(72) Inventors: Po-Jen Tu, New Taipei (TW); Jia-Ren Chang, New Taipei (TW); Kai-Meng Tzeng, New Taipei (TW)

(73) Assignee: Acer Incorporated, New Taipei (TW)

( * ) Notice: Subject to any disclaimer, the term of this patent is extended or adjusted under 35 U.S.C. 154(b) by 133 days.

(21) Appl. No.: 14/799,589

(22) Filed: Jul. 15, 2015

(65) Prior Publication Data

US 2016/0343388 A1 Nov. 24, 2016

(30) Foreign Application Priority Data

May 20, 2015 (TW) ..... 104116032 A

(51) Int. Cl.
*G10L 21/01* (2013.01)
*G10L 21/02* (2013.01)
*H04R 25/00* (2006.01)

(52) U.S. Cl.
CPC ..... *G10L 21/01* (2013.01); *G10L 21/0205* (2013.01); *H04R 25/70* (2013.01); *H04R 2225/43* (2013.01)

(58) Field of Classification Search
CPC ..... H04N 2201/0094; H04N 1/00244
USPC ..... 704/205
See application file for complete search history.

(56) References Cited

U.S. PATENT DOCUMENTS

2015/0049879 A1* 2/2015 Young ..... H04R 3/04 381/98
2016/0210987 A1* 7/2016 Sugiyama ..... G10L 21/0232

* cited by examiner

*Primary Examiner* — Houshang Safaipour
*Assistant Examiner* — Bharatkumar S Shah
(74) *Attorney, Agent, or Firm* — Jianq Chyun IP Office

(57) ABSTRACT

A voice signal processing apparatus and a voice signal processing method are provided. A first sampling point of an $m^{th}$ original frequency-lowered signal frame phase-matched to the sampling point corresponding to a phase reference sampling point number is determined according to the phase reference sampling point number of an $(m-1)^{th}$ original frequency-lowered signal frame corresponding to a middle sampling point of an $(m-1)^{th}$ renovating frequency-lowered signal frame. The q consecutive sampling points starting from the first sampling point are used as the sampling points of an $m^{th}$ renovating frequency-lowered signal frame.

21 Claims, 7 Drawing Sheets

VOICE SIGNAL PROCESSING APPARATUS AND VOICE SIGNAL PROCESSING METHOD

CROSS-REFERENCE TO RELATED APPLICATION

This application claims the priority benefit of Taiwan application serial no. 104116032, filed on May 20, 2015. The entirety of the above-mentioned patent application is hereby incorporated by reference herein and made a part of this specification.

BACKGROUND OF THE INVENTION

Field of the Invention

The invention relates to a signal processing apparatus, and more particularly, to a voice signal processing apparatus and a voice signal processing method.

Description of Related Art

In general, hearing-impaired people can clearly hear low frequency signals but have trouble receiving high frequency voice signals (e.g., a consonant signal). In the conventional technology, such issue is generally solved by lowering a frequency of the high frequency signal and overlapping signal frames. Since a time length is extended after lowering the frequency of the signal, it is required to use an interpolation method for calculating signal values between two consecutive sampling signals. Because a characteristic of a sound signal is relatively similar to a characteristic of a sinusoidal wave, a signal distortion often occurs on a frequency-lowered signal if interpolation signal values are calculated by a common method for calculating arithmetic mean. Furthermore, during the conventional operation for overlapping the signal frames, whether their phases match to each other is usually not taken into consideration. Therefore, a condition where a part of the signals are added while another part of the signals are subtracted may occur on an overlapping section to cause the signal distortion. Worth yet, the signal distortion becomes even more serious as a magnitude for lowering frequency gets larger.

SUMMARY OF THE INVENTION

The invention is directed to a voice signal processing apparatus and a voice signal processing method, capable of effectively solving an issue of a signal distortion caused by a phase mismatching condition occurred when signal frames are overlapped in a process of further lowering a frequency of a sampling signal.

The voice signal processing apparatus of the invention includes a processing unit, which is configured to lower a sampling voice signal to generate a frequency-lowered signal including a sequence of original frequency-lowered signal frames, and generate corresponding renovating frequency-lowered signal frames according to the original frequency-lowered signal frames. Herein, each of the original frequency-lowered signal frames includes p sampling points. The processing unit determines a first sampling point of an $m^{th}$ original frequency-lowered signal frame phase-matched to the sampling point corresponding to a phase reference sampling point number according to the phase reference sampling point number of an $(m-1)^{th}$ original frequency-lowered signal frame corresponding to a middle sampling point of an $(m-1)^{th}$ renovating frequency-lowered signal frame, uses q consecutive sampling points starting from the first sampling point phase-matched to the sampling point corresponding to the phase reference sampling point number as the sampling points of an $m^{th}$ renovating frequency-lowered signal frame, overlaps adjacent two of the renovating frequency-lowered signal frames to generate an overlapped voice signal, wherein the phase reference sampling point number is a number of the sampling point of the $(m-1)^{th}$ original frequency-lowered signal frame corresponding to the middle sampling point of the $(m-1)^{th}$ renovating frequency-lowered signal frame, p and q are positive integers, and m is a positive integer greater than 1.

In an embodiment of the invention, a frequency of the frequency-lowered signal is one fourth the frequency of the sampling voice signal, and a length of each of the renovating frequency-lowered signal frames is equal to one half a length of each of the original frequency-lowered signal frames.

In an embodiment of the invention, each of the adjacent two of the renovating frequency-lowered signal frames includes a 50% overlapping section.

In an embodiment of the invention, the processing unit further counts a first count value and a second count value according to sampling values of the sampling points of the $m^{th}$ original frequency-lowered signal frame, wherein when the sampling point corresponding to the sampling value being 0 or a sampling point adjacent to the sampling point corresponding to the sampling value being 0 is counted, the processing unit returns the first count value or the second count value to zero, the processing unit uses the first count value or the second count value of the $m^{th}$ original frequency-lowered signal frame corresponding to the sampling point corresponding to the phase reference sampling point number as a reference value, and determines the first sampling point of the $m^{th}$ original frequency-lowered signal frame phase-matched to the sampling point corresponding to the phase reference sampling point number according to the reference value.

In an embodiment of the invention, the processing unit further determine whether the first count value of the $(m-1)^{th}$ original frequency-lowered signal frame corresponding to the sampling point corresponding to the phase reference sampling point number is less than or equal to the second count value of the $(m-1)^{th}$ original frequency-lowered signal frame corresponding to the sampling point corresponding to the phase reference sampling point number. If the first count value of the $(m-1)^{th}$ original frequency-lowered signal frame corresponding to the sampling point corresponding to the phase reference sampling point number is less than or equal to the second count value of the $(m-1)^{th}$ original frequency-lowered signal frame corresponding to the sampling point corresponding to the phase reference sampling point number, the processing unit uses the first count value of the $(m-1)^{th}$ original frequency-lowered signal frame corresponding to the sampling point corresponding to the phase reference sampling point number as the reference value, and uses a very-first-sampled sampling point among the sampling points of the $m^{th}$ original frequency-lowered signal frame where the first count value is equal to the reference value as the first sampling point of the $m^{th}$ original frequency-lowered signal frame phase-matched to the sampling point corresponding to the phase reference sampling point number; and if the first count value of the $(m-1)^{th}$ original frequency-lowered signal frame corresponding to the sampling point corresponding to the phase reference sampling point number is not less than or equal to the second count value of the $(m-1)^{th}$ original frequency-lowered signal frame corresponding to the sampling point corresponding to the phase reference sampling point number, the processing unit uses the second count value of the $(m-1)^{th}$ original frequency-lowered signal frame corresponding to the sampling point corresponding to the phase reference sampling point number as the reference value, and uses a very-first-sampled sampling point among the sampling points of the $m^{th}$ original frequency-lowered signal frame where the second count value is equal to the reference value as the first sampling point of the $m^{th}$ original frequency-lowered signal frame phase-matched to the sampling point corresponding to the phase reference sampling point number.

In an embodiment of the invention, the processing unit further multiplies the frequency-lowered signal by a Hamming window.

In an embodiment of the invention, the processing unit further calculates a value of an interpolation parameter function corresponding to each of the original frequency-lowered signal frames according to three consecutive sampling values of each of the original frequency-lowered signal frames, and calculates an interpolation value between adjacent two of the sampling points of each of the original frequency-lowered signal frames according to the value of the interpolation parameter function corresponding to each of the original frequency-lowered signal frames.

In an embodiment of the invention, the processing unit further determines whether the value of the interpolation parameter function is less than an upper limit value and greater than or equal to a lower limit value, and if the value of the interpolation parameter function is not less than the upper limit value or not greater than or equal to the lower range value, the processing unit corrects the value of the interpolation parameter function, wherein if the value of the interpolation parameter function is greater than or equal to the upper limit value, the processing unit corrects the value of the interpolation parameter function to be the upper limit value, and if the value of the interpolation parameter function is less than the lower limit value, the processing unit corrects the value of the interpolation parameter function to be the lower value.

In an embodiment of the invention, the sampling voice signal is generated by sampling an original voice signal, and the upper limit value and the lower limit value are associated with a frequency of the original voice signal and a sampling frequency for sampling the original voice signal.

In an embodiment of the invention, the processing unit further calculates the interpolation parameter function corresponding to each of the original frequency-lowered signal frames according to a trigonometric function relationship of the three consecutive sampling values of each of the original frequency-lowered signal frames, wherein the interpolation parameter function is a trigonometric function.

The voice signal processing method of the invention includes the following steps. A frequency of a sampling voice signal is lowered to generate a frequency-lowered signal including a sequence of original frequency-lowered signal frames. Herein, each of the original frequency-lowered signal frames includes p sampling points, wherein p is a positive integer. A first sampling point of an $m^{th}$ original frequency-lowered signal frame phase-matched to the sampling point corresponding to a phase reference sampling point number is determined according to the phase reference sampling point number of an $(m-1)^{th}$ original frequency-lowered signal frame corresponding to a middle sampling point of an $(m-1)^{th}$ renovating frequency-lowered signal frame. Herein, m is a positive integer greater than 1, and the phase reference sampling point number is a number of the sampling point of the $(m-1)^{th}$ original frequency-lowered signal frame corresponding to the middle sampling point of the $(m-1)^{th}$ renovating frequency-lowered signal frame. The q consecutive sampling points starting from the first sampling point phase-matched to the sampling point corresponding to the phase reference sampling point number are used as the sampling points of an $m^{th}$ renovating frequency-lowered signal frame. Herein, q is a positive integer. Adjacent two of the renovating frequency-lowered signal frames are overlapped to generate an overlapped voice signal.

In an embodiment of the invention, a frequency of the frequency-lowered signal is one fourth the frequency of the sampling voice signal, and a length of each of the renovating frequency-lowered signal frames is equal to one half a length of each of the original frequency-lowered signal frames.

In an embodiment of the invention, each of the adjacent two of the renovating frequency-lowered signal frames includes a 50% overlapping section.

In an embodiment of the invention, the step of determining the first sampling point of the $m^{th}$ original frequency-lowered signal frame phase-matched to the sampling point corresponding to the phase reference sampling point number according to the phase reference sampling point number of the $(m-1)^{th}$ original frequency-lowered signal frame corresponding to the middle sampling point of the $(m-1)^{th}$ renovating frequency-lowered signal frame includes the following steps. A first count value and a second count value are counted according to sampling values of the sampling points of the $m^{th}$ original frequency-lowered signal frame. Herein when the sampling point corresponding to the sampling value being 0 or a sampling point adjacent to the sampling point corresponding to the sampling value being 0 is counted, the corresponding first count value or the corresponding second count value is returned to zero. The first count value or the second count value of the $m^{th}$ original frequency-lowered signal frame corresponding to the sampling point corresponding to the phase reference sampling point number is used as a reference value. The first sampling point of the $m^{th}$ original frequency-lowered signal frame phase-matched to the sampling point corresponding to the phase reference sampling point number is determined according to the reference value.

In an embodiment of the invention, the step of using the first count value or the second count value of the $m^{th}$ original frequency-lowered signal frame corresponding to the sampling point corresponding to the phase reference sampling point number as the reference value includes the following steps. Whether the first count value of the $(m-1)^{th}$ original frequency-lowered signal frame corresponding to the sampling point corresponding to the phase reference sampling point number is less than or equal to the second count value of the $(m-1)^{th}$ original frequency-lowered signal frame corresponding to the sampling point corresponding to the phase reference sampling point number is determined. If the first count value of the $(m-1)^{th}$ original frequency-lowered signal frame corresponding to the sampling point corresponding to the phase reference sampling point number is less than or equal to the second count value of the $(m-1)^{th}$ original frequency-lowered signal frame corresponding to the sampling point corresponding to the phase reference sampling point number, the first count value of the $(m-1)^{th}$ original frequency-lowered signal frame corresponding to the sampling point corresponding to the phase reference sampling point number is used as the reference value. If the first count value of the $(m-1)^{th}$ original frequency-lowered signal frame corresponding to the sampling point corresponding to the phase reference sampling point number is not less than or equal to the second count value of the $(m-1)^{th}$ original frequency-lowered signal frame corresponding to the sampling point corresponding to the phase reference sampling point number, the second count value of the $(m-1)^{th}$ original frequency-lowered signal frame corresponding to the sampling point corresponding to the phase reference sampling point number is used as the reference value.

In an embodiment of the invention, if the first count value of the $(m-1)^{th}$ original frequency-lowered signal frame corresponding to the sampling point corresponding to the phase reference sampling point number is less than or equal to the second count value of the $(m-1)^{th}$ original frequency-lowered signal frame corresponding to the sampling point corresponding to the phase reference sampling point number, the voice signal processing method further includes: using a very-first-sampled sampling point among the sampling points of the $m^{th}$ original frequency-lowered signal frame where the first count value is equal to the reference value as the first sampling point of the $m^{th}$ original frequency-lowered signal frame phase-matched to the sampling point corresponding to the phase reference sampling point number.

In an embodiment of the invention, if the first count value of the $(m-1)^{th}$ original frequency-lowered signal frame corresponding to the sampling point corresponding to the phase reference sampling point number is less than or equal to the second count value of the $(m-1)^{th}$ original frequency-lowered signal frame corresponding to the sampling point corresponding to the phase reference sampling point number, the voice signal processing method further includes: using a very-first-sampled sampling point among the sampling points of the $m^{th}$ original frequency-lowered signal frame where the second count value is equal to the reference value as the first sampling point of the $m^{th}$ original frequency-lowered signal frame phase-matched to the sampling point corresponding to the phase reference sampling point number.

In an embodiment of the invention, the voice signal processing method includes multiplying the frequency-lowered signal by a Hamming window.

In an embodiment of the invention, the voice signal processing method includes the following steps. A value of an interpolation parameter function corresponding to each of the original frequency-lowered signal frames is calculated according to three consecutive sampling values of each of the original frequency-lowered signal frames. Whether the value of the interpolation parameter function is less than an upper limit value and greater than or equal to a lower limit value is determined, and if the value of the interpolation parameter function is not less than the upper limit value or not greater than or equal to the lower range value, the value of the interpolation parameter function is corrected. An interpolation value between adjacent two of the sampling points of each of the frequency-lowered signal frames is calculated according to the value of the interpolation parameter function corresponding to each of the frequency-lowered signal frames.

In an embodiment of the invention, if the value of the interpolation parameter function is greater than or equal to the upper limit value, the value of the interpolation parameter function is corrected to be the upper limit value, and if the value of the interpolation parameter function is less than the lower limit value, the value of the interpolation parameter function is calculated to be the lower value. Herein, the sampling voice signal is generated by sampling an original voice signal, and the upper limit value and the lower limit value are associated with a frequency of the original voice signal and a sampling frequency for sampling the original voice signal.

In an embodiment of the invention, the voice signal processing method includes: calculating the interpolation parameter function corresponding to each of the original frequency-lowered signal frames according to a trigonometric function relationship of the three consecutive sampling values of each of the original frequency-lowered signal frames, wherein the interpolation parameter function is a trigonometric function.

Based on the above, according to the embodiments of the invention, a first sampling point of an $m^{th}$ original frequency-lowered signal frame phase-matched to the sampling point corresponding to a phase reference sampling point number is determined according to the phase reference sampling point number of an $(m-1)^{th}$ original frequency-lowered signal frame corresponding to a middle sampling point of an $(m-1)^{th}$ renovating frequency-lowered signal frame, and the q consecutive sampling points starting from the first sampling point phase-matched to the sampling point corresponding to the phase reference sampling point number are used as the sampling points of an $m^{th}$ renovating frequency-lowered signal frame. As a result, when the frequency of the sampling voice signal is further lowered (e.g., when the frequency is to be lowered to be one fourth), the issue of the signal distortion caused by the phase mismatching condition occurred when the signal frames are overlapped may still be effectively solved.

To make the above features and advantages of the present disclosure more comprehensible, several embodiments accompanied with drawings are described in detail as follows.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
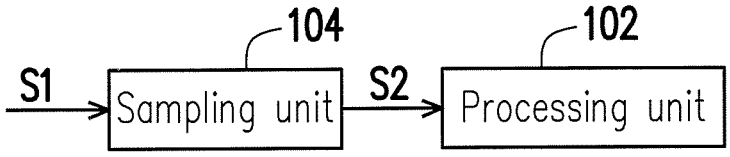
FIG. 1 is a schematic diagram illustrating a voice signal processing apparatus according to an embodiment of the invention.

Reference will now be made in detail to the present preferred embodiments of the invention, examples of which are illustrated in the accompanying drawings. Wherever possible, the same reference numbers are used in the drawings and the description to refer to the same or like parts.

Figure 2:
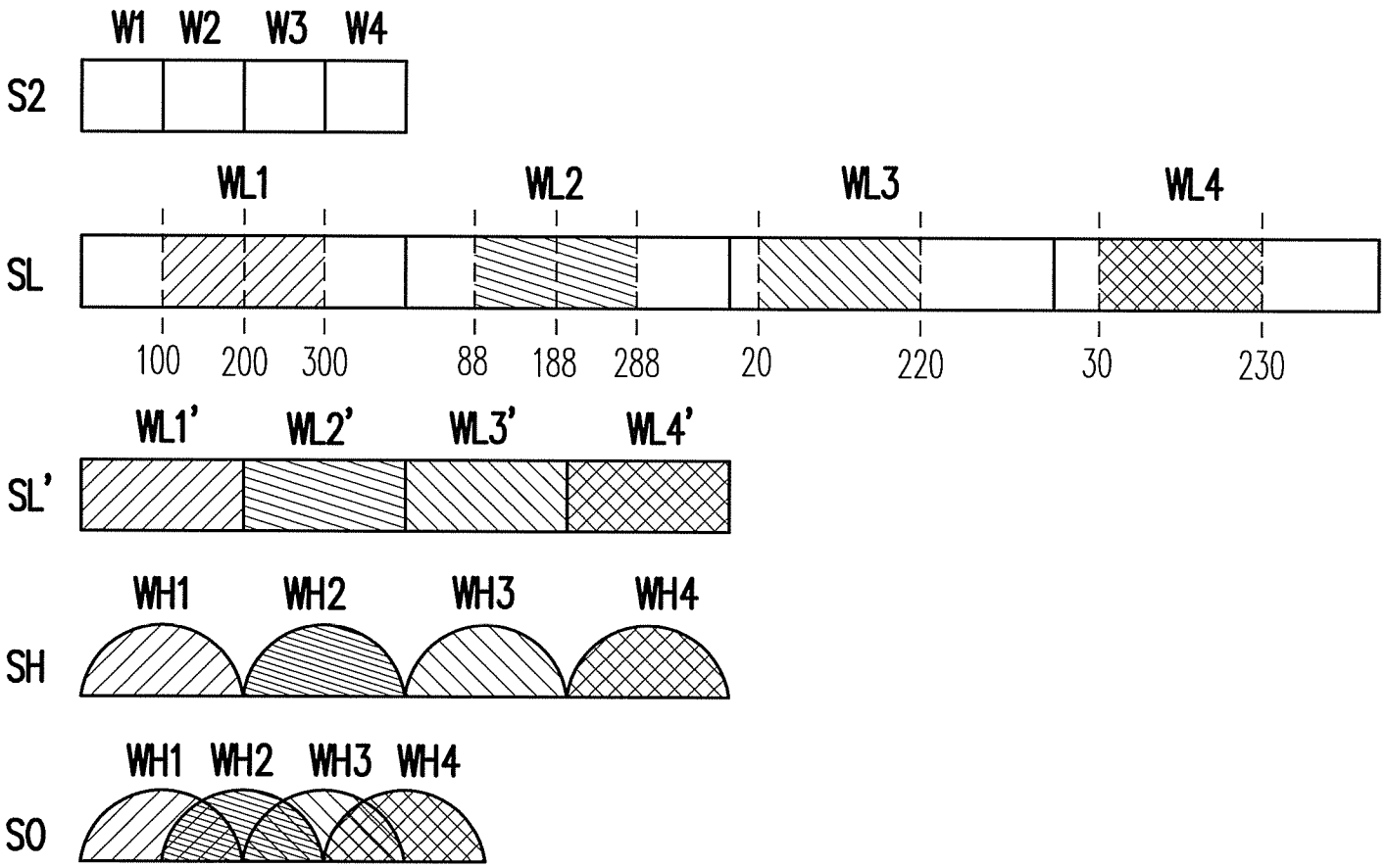
FIG. 2 is a schematic diagram illustrating a signal process for a sampling voice signal according to an embodiment of the invention.

Referring to FIG. 1, FIG. 1 is a schematic diagram illustrating a voice signal processing apparatus according to an embodiment of the invention. A voice signal processing apparatus includes a processing unit 102 and a sampling unit 104, and the processing unit 102 is coupled to the sampling unit 104. Herein, the processing unit 102 may be implemented by a central processing unit, for example; and the sampling unit 104 may be implemented by a logic circuit, for example, but the invention is not limited thereto. The sampling unit 104 is capable of sampling an original voice signal S1 to generate a sampling voice signal S2. The processing unit 102 is capable of lowering a frequency of the sampling voice signal S2 to generate a frequency-lowered signal including a sequence of frequency-lowered signal frames. As shown by the schematic diagram illustrating the signal process for the sampling voice signal S2 in FIG. 2, the sampling voice signal S2 may include a sequence of sampling signal frames. For clearer description, only four sampling frames W1 to W4 are illustrated in the embodiment of FIG. 2, but the invention is not limited thereto. A frequency-lowered signal SL includes the original frequency-lowered signal frames WL1 to WL4. Because the frequency-lowered signal SL is obtained by lowering the frequency of the sampling voice signal S2, a length of the original frequency-lowered signal frame is greater than a length of the sampling signal frame of the sampling voice signal S2. In the present embodiment, a frequency of the frequency-lowered signal SL is one fourth the frequency of the sampling voice signal S2 (accordingly, the length of each of the original frequency-lowered signal frames is four times the length of the corresponding sampling signal frame), but the invention is not limited thereto.

The processing unit 102 may select a part of sampling points from among the original frequency-lowered signal frames to obtain renovating frequency-lowered signal frames (e.g., renovating frequency-lowered signal frames WL1' to WL4' in FIG. 2, wherein the length of each of the renovating frequency-lowered signal frames is equal to one half the length of each of the original frequency-lowered signal frames in the present embodiment), and make a middle sampling point of each of the renovating frequency-lowered signal frames to be phase-matched to an initial sampling point of the next renovating frequency-lowered signal frame, so as to solve the issue of the signal distortion caused by the phase mismatching condition occurred when the signal frames are overlapped.

Specifically, a part of the sampling points of the original frequency-lowered signal frames may be obtained by executing an interpolation operation. The processing unit 102 may first calculate a value of an interpolation parameter function corresponding to each of the original frequency-lowered signal frames according to three consecutive known sampling values of each of the original frequency-lowered signal frames, and then calculate an interpolation value between adjacent two of known sampling points of each of the original frequency-lowered signal frames according to the value of the interpolation parameter function corresponding to each of the original frequency-lowered signal frames. Herein, the interpolation parameter function is a trigonometric function such as a sine function or a cosine function, but the invention is not limited thereto.

Figure 3:
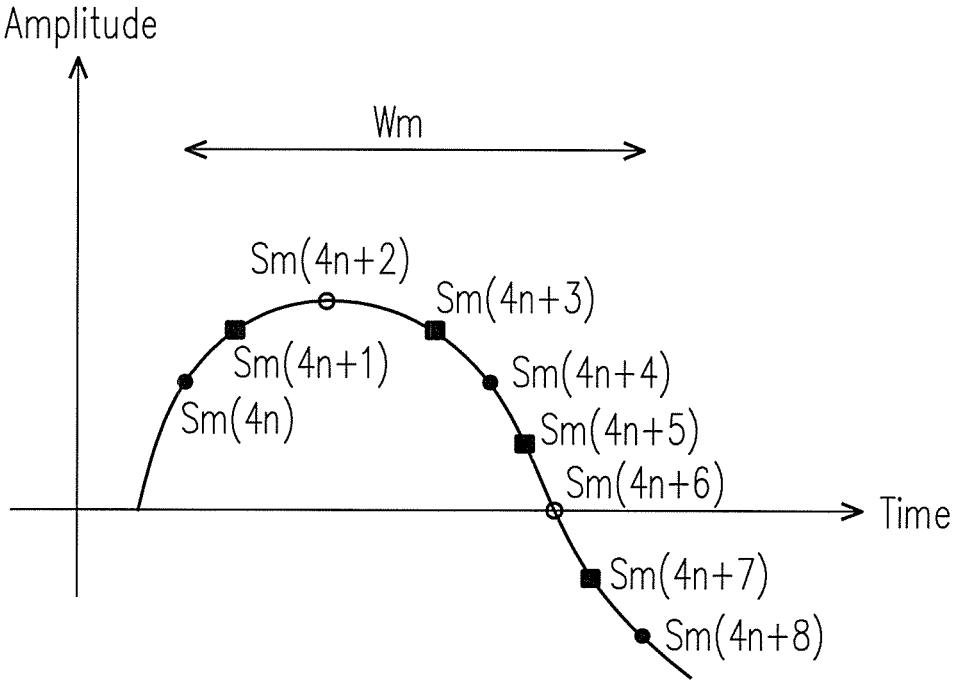
FIG. 3 is a schematic diagram illustrating a frequency-lowered signal according to an embodiment of the invention.

For instance, referring to FIG. 3, FIG. 3 is a schematic diagram illustrating a frequency-lowered signal according to an embodiment of the invention. In FIG. 3, solid dots refer to a known sampling point in the original frequency-lowered signal frame, hollow dots refer to an interpolation point calculated by performing the interpolation operation on the known sampling points by the processing unit 102, and square points refer to an interpolation point calculated by performing the interpolation operation again on the known sampling point and previously-calculated interpolation point by the processing unit 102. The processing unit 102 may calculate the interpolation parameter function corresponding to each of the original frequency-lowered signal frames according to the sampling values of the three consecutive known sampling points of each of the original frequency-lowered signal frames. For example, an interpolation parameter function $C_m(g)$ corresponding to an $m^{th}$ original frequency-lowered signal frame Wm may be obtained according to a trigonometric function relationship of sampling values of three sampling points $s_m(4n)$, $s_m(4n+4)$ and $s_m(4n+8)$ consecutively sampled in the original frequency-lowered signal frame, and the corresponding interpolation parameter function within a time range of the original frequency-lowered signal frame Wm may be represented by following formula:

$$C_m(g) = \frac{s_m(4g) + s_m(4g+8) + 2s_m(4g+4)}{4s_m(4g+4)} \tag{1}$$

Herein, g is 0 or a positive integer, $C_m(g)$ is a function value of the interpolation parameter function at a time-point g, and the interpolation parameter function $C_m(g)$ is a trigonometric function.

Because noises may occur during the signal process of the voice signal processing apparatus, the calculated value of the interpolation parameter function may include noise components which influence an accuracy of the processing unit 102 for obtaining the interpolation value. The processing unit 102 may check whether the value of the interpolation parameter function suffers a noise interference by determining whether the value of the interpolation parameter function falls within a preset range. For example, whether the value of the interpolation parameter function is less than an upper limit value and greater than or equal to a lower limit value may be determined. If the value of the interpolation parameter function is not less than the upper limit value or is not greater than or equal to the lower limit value, it indicates that the value of the interpolation parameter function suffers the noise interference. As such, the processing unit 102 may correct the value of the interpolation parameter function, so as to remove the noise components included in the value of the interpolation parameter function. For example, if the value of the interpolation parameter function is greater than or equal to the upper limit value, the processing unit 102 may correct the value of the interpolation parameter function to be the upper limit value; if the value of the interpolation parameter function is less than the lower limit value, the processing unit 102 may correct the value of the interpolation parameter function to be the lower limit value; and if the value of the interpolation parameter function is less than the upper limit value and greater than or equal to the lower limit value, there is no need to correct the value of the interpolation parameter function. For instance, in the embodiment of FIG. 3, correction of the value of the interpolation parameter function $C_m(g)$ may be represented by the following formula:

$$C_m(g) = \begin{cases} C_m(g), & 0.5 \le C_m(g) < 1 \\ 0.5, & C_m(g) < 0.5 \\ 1, & C_m(g) \ge 1 \end{cases} \quad (2)$$

Namely, the upper limit value and the lower limit value in the embodiment of FIG. 3 are 1 and 0.5 respectively. If the value of the interpolation parameter function $C_m(g)$ is greater than or equal to 1 because the value is influenced by the noises during the signal process of the voice signal processing apparatus, the processing unit 102 corrects the value of the interpolation parameter function $C_m(g)$ to be 1; and if the value of the interpolation parameter function $C_m(g)$ is less than 0.5, the processing unit 102 corrects the value of the interpolation parameter function $C_m(g)$ to be 0.5. It should be noted that, the upper limit value and the lower limit value in formula (2) are only exemplary examples, and the invention is not limited thereto. Herein, the upper limit value and the lower limit value may be adjusted depending on actual condition in the noise interference. For example, the upper limit value and the lower limit value may be adjusted according to a frequency of the original voice signal and a sampling frequency of the sampling unit.

After obtaining the value of the interpolation parameter function, the processing unit 102 may calculate the interpolation value between adjacent two of the sampling points of the original frequency-lowered signal frame according to the interpolation parameter function. Taking the embodiment of FIG. 3 as an example, an interpolation point $s_m(4n+2)$ between the sampling points $s_m(4n)$ and $S_m(4n+4)$ and an interpolation point $s_m(4n+6)$ between the sampling points $s_m(4n+4)$ and $s_m(4n+8)$ in the original frequency-lowered signal frame Wm may respectively be represented by the following formulas:

$$s_m(4n+2) = \frac{s_m(4n) + s_m(4n+4)}{2\sqrt{C_m\left(\frac{n}{2}\right)}} \quad (3)$$

$$s_m(4n+6) = \frac{s_m(4n+4) + s_m(4n+8)}{2\sqrt{C_m\left(\frac{n}{2}\right)}} \quad (4)$$

In formula (3) and formula (4), n is 0 or a positive even number.

Similarly, the square points in FIG. 3 may also be obtained by using the interpolation operation for the hollow dots. For example, the processing unit 102 may obtain the interpolation parameter function $C_m'(n)$ according to the trigonometric function relationship of the sampling point $s_m(4n)$, the interpolation point $s_m(4n+2)$ and the sampling point $s_m(4n+4)$, and the corresponding interpolation parameter function $C_m'(n)$ within the time range of the original frequency-lowered signal frame Wm may be represented by the following formula:

$$C_m'(n) = \frac{s_m(4n) + s_m(4n+4) + 2s_m(4n+2)}{4s_m(4n+2)} \quad (5)$$

Herein, n is 0 or a positive even number, and correction of the value of the interpolation parameter function $C_m'(n)$ may be represented by the following formula:

$$C_m'(n) = \begin{cases} C_m'(n), & 0.85 \le C_m'(n) < 1 \\ 0.85, & C_m'(n) < 0.85 \\ 1, & C_m'(n) \ge 1 \end{cases} \quad (6)$$

An interpolation point $s_m(4n+1)$ between the sampling point $s_m(4n)$ and the interpolation point $s_m(4n+2)$ and an interpolation point $s_m(4n+3)$ between the interpolation point $s_m(4n+2)$ and the sampling point $s_m(4n+4)$ in the original frequency-lowered signal frame Wm may respectively be represented by the following formulas:

$$s_m(4n+1) = \frac{s_m(4n) + s_m(4n+2)}{2\sqrt{C_m'(n)}} \quad (7)$$

$$s_m(4n+3) = \frac{s_m(4n+2) + s_m(4n+4)}{2\sqrt{C_m'(n)}} \quad (8)$$

In addition, the processing unit 102 may obtain the interpolation parameter function $C_m''(n)$ according to the trigonometric function relationship of the sampling point $s_m(4n+4)$, the interpolation point $s_m(4n+6)$ and the sampling point $s_m(4n+8)$, and the corresponding interpolation parameter function $C_m''(n)$ within the time range of the original frequency-lowered signal frame Wm may be represented by the following formula:

$$C_m''(n) = \frac{s_m(4n+4) + s_m(4n+8) + 2s_m(4n+6)}{4s_m(4n+6)} \quad (9)$$

Herein, n is 0 or a positive even number, and correction of the value of the interpolation parameter function $C_m''(n)$ may be represented by the following formula:

$$C_m''(n) = \begin{cases} C_m''(n), & 0.85 \le C_m''(n) < 1 \\ 0.85, & C_m''(n) < 0.85 \\ 1, & C_m''(n) \ge 1 \end{cases} \quad (10)$$

An interpolation point $s_m(4n+5)$ between the sampling point $s_m(4n+4)$ and the interpolation point $s_m(4n+6)$ and an interpolation point $s_m(4n+7)$ between the interpolation point $s_m(4n+6)$ and the sampling point $s_m(4n+8)$ in the original frequency-lowered signal frame Wm may respectively be represented by the following formulas:

$$s_m(4n+5) = \frac{s_m(4n+4) + s_m(4n+6)}{2\sqrt{C_m''(n)}} \quad (11)$$

$$s_m(4n+7) = \frac{s_m(4n+6) + s_m(4n+8)}{2\sqrt{C_m''(n)}} \quad (12)$$

By analogy, the interpolation value between the sampling points or the interpolation value between the sampling point and the interpolation point in each other original frequency-lowered signal frames may also be obtained by the same method, and persons skilled in the art should be able to infer their implementations based on teachings in the foregoing embodiment, which are not repeated hereinafter.

As described above, in the present embodiment, the interpolation value between the sampling points (or the interpolation value between the sampling point and the interpolation value) is estimated by using the trigonometric function, and the interpolation value between the adjacent two of the sampling points of the original frequency-lowered signal frame (or the interpolation value between the sampling point and the interpolation value which are adjacent to each other) is calculated according to the interpolation parameter function, the interpolation values are used to serve as sampling values of new sampling points between the known sampling points of the frequency-lowered signal. Because a characteristic of the trigonometric function is relatively similar to a characteristic of a sound signal, as compared to the conventional technology which simply obtains the interpolation value by using the arithmetic mean, a more accurate interpolation value may be obtained by the calculation used in the present embodiment to effectively avoid occurrences of the signal distortion on the frequency-lowered signal after the frequency is lowered.

In addition, each of said original frequency-lowered signal frames may include p sampling points (wherein p is a positive integer, and P may be equal to 4N−3 where N is a positive integer greater than 1 in the present embodiment), the processing unit 102 may use a number of a sampling point of an $(m-1)^{th}$ original frequency-lowered signal frame corresponding to a middle sampling point of an $(m-1)^{th}$ renovating frequency-lowered signal frame as a phase reference sampling point number, determine a first sampling point of the $m^{th}$ original frequency-lowered signal frame phase-matched to a sampling point corresponding to the phase reference sampling point number according to the phase reference sampling point number, and use q consecutive sampling points starting from the first sampling point as sampling points of an $m^{th}$ renovating frequency-lowered signal frame (wherein q is a positive integer, and q may be 2N−1 where N is a positive integer greater than 1 in the present embodiment), so that the middle sampling point of the $(m-1)^{th}$ renovating frequency-lowered signal frame is phase-matched to the initial sampling point of the $m^{th}$ renovating frequency-lowered signal frame, wherein m is a positive integer larger than 1. Accordingly, when a 50% signal frame overlapping operation is performed on the $(m-1)^{th}$ renovating frequency-lowered signal frame and the $m^{th}$ renovating frequency-lowered signal frame (i.e., for making each of the $(m-1)^{th}$ renovating frequency-lowered signal frame and the renovating frequency-lowered signal frame to include a 50% overlapping section), occurrences of the phase mismatching may be substantially reduced to solve the issue of the signal distortion.

Specifically, the processing unit 102 may count a first count value and a second count value according to the sampling values of the sampling points of the $m^{th}$ original frequency-lowered signal frame. Herein, when the sampling point corresponding to the sampling value being 0 or a sampling point adjacent to the sampling point corresponding to the sampling value being 0 (e.g., a previous one or a next one of the adjacent sampling points, but the invention is not limited thereto) is counted by the processing unit 102, the first count value or the second count value is returned to zero. Specifically, a method for counting aforesaid count values may be represented by the following formulas (13) to (16):

$$PN_m(n) = \begin{cases} 10, & s_m(n) > 0 \\ 3, & s_m(n) = 0 \\ 0, & s_m(n) < 0 \end{cases} \tag{13}$$

-continued $$PN_m^D(n) = PN_m(n) - PN_m(n-1) \tag{14}$$

$$Cot_m^+(n) = \begin{cases} 0, & PN_m^D(n) = 10 \text{ or } 7 \\ Cot_m^+(n-1)+1, & \text{else} \end{cases} \tag{15}$$

$$Cot_m^-(n) = \begin{cases} 0, & PN_m^D(n) = -10 \text{ or } -3 \\ Cot_m^-(n-1)+1, & \text{else} \end{cases} \tag{16}$$

Among them, m is a positive integer greater than 1, n=0, 1, 2, . . . , 4N−4, N is a positive integer greater than 1, $s_m(n)$ is the sampling value of the sampling point of a number n of the $m^{th}$ original frequency-lowered signal frame, and $PN_m(n)$ is used to convert the sampling value $s_m(n)$ into values represented by "10", "3" or "0", wherein $PN_m(-1)=PN_m(0)$. $Cot_m^+(n)$ is the first count value corresponding to the sampling point of the number n of the $m^{th}$ original frequency-lowered signal frame, and $Cot_m^-(n)$ is the second count value corresponding to the sampling point of the number n of the $m^{th}$ original frequency-lowered signal frame, wherein $Cot_m^+(-1)=2N-2$ and $Cot_m^-(-1)=2N-2$. In view of formulas (15) and (16), it can be known that, $Cot_m^+(n)$ is an accumulated count value corresponding to the frequency-lowered signal in a positive half cycle, whereas $Cot_n^-(n)$ is an accumulated count value corresponding to the frequency-lowered signal in a negative half cycle. As shown in formulas (13) to (16), in the present embodiment, the sampling value $s_m(n)$ being greater than 0, the sampling value $s_m(n)$ being equal to 0 and the sampling value $s_m(n)$ being less than 0 are set to 10, 3 and 0 respectively, the first count values corresponding to $PN_m^D(n)$ being equal to 10 or 7 are returned to zero when the first count value $Cot_m^+(n)$ is counted, and the second count values corresponding to $PN_m^D(n)$ being equal to −10 or −3 are also returned to zero when the second count value $Cot_m^-(n)$ is counted. Because the sampling value is set to be 3 when the sampling value $s_m(n)$ is equal to 0, positions of the values of $PN_m^D(n)$ being equal to 10, 7, −10 or −3 will appear at positions of the sampling points adjacent to the sampling point where the sampling value $s_m(n)$ is equal to 0.

The processing unit 102 may use the first count value or the second value of the $m^{th}$ original frequency-lowered signal frame corresponding to the sampling point of the phase reference sampling point number obtained from the $(m-1)^{th}$ original frequency-lowered signal frame (which is obtained by the processing unit 102 which counts in the $(m-1)^{th}$ original frequency-lowered signal frame, and a counting method thereof is identical to the counting method used by the processing unit 102 in the $m^{th}$ original frequency-lowered signal frame) as a reference value, and determine the first sampling point of the $m^{th}$ original frequency-lowered signal frame phase-matched to the sampling point corresponding to the phase reference sampling point number according to the reference value. For example, the processing unit 102 may determine whether the first count value of the $(m-1)^{th}$ original frequency-lowered signal frame corresponding to the sampling point corresponding to the phase reference sampling point number is less than or equal to the second count value of the $(m-1)^{th}$ original frequency-lowered signal frame corresponding to the sampling point corresponding to the phase reference sampling point number, and such determination may be represented by the following formula (17):

$$Cot_{m-1}^{+S} \geq Cot_{m-1}^{-S} \tag{17}$$

Herein, $Cot_{m-1}^{+S}$ is the first count value of the $(m-1)^{th}$ original frequency-lowered signal frame corresponding to the sampling point corresponding to the phase reference sampling point number, and $Cot_{m-1}^{-S}$ is the second count value of the $(m-1)^{th}$ original frequency-lowered signal frame corresponding to the sampling point corresponding to the phase reference sampling point number.

If the first count value of the $(m-1)^{th}$ original frequency-lowered signal frame corresponding to the sampling point corresponding to the phase reference sampling point number is less than or equal to the second count value of the $(m-1)^{th}$ original frequency-lowered signal frame corresponding to the sampling point corresponding to the phase reference sampling point number, the processing unit 102 uses the first count value of the $(m-1)^{th}$ original frequency-lowered signal frame corresponding to the sampling point corresponding to the phase reference sampling point number as the reference value, and uses a very-first-sampled sampling point among the sampling points whose first count values are equal to the reference value of the $m^{th}$ original frequency-lowered signal frame as the first sampling point. Aforesaid operations may be represented by the following formulas (18) and (19):

$$n_{Cot_m}^{+}(n) = \begin{cases} n, & Cot_m^{+}(n) = Cot_{m-1}^{+S} \\ 4N-4, & \text{else} \end{cases} \tag{18}$$

$$n_{Cot_m} = \min\{n_{Cot_m}^{+}(n)\} \tag{19}$$

In view of formulas (18) and (19), it can be known that, when the first count value of the $m^{th}$ original frequency-lowered signal frame corresponding to the sampling point of the number n is equal to the first count value of the $(m-1)^{th}$ original frequency-lowered signal frame corresponding to the sampling point corresponding to the phase reference sampling point number, $n_{Cot_m}^{+}(n)$ is equal to the number n corresponding to the sampling point; otherwise, $n_{Cot_m}^{+}(n)$ is equal to 4N−4. $n_{Cot_m}$ is a minimum value among all $n_{Cot_m}^{+}(n)$, which represents the number of the first sampling point of the $m^{th}$ original frequency-lowered signal frame phase-matched to the sampling point corresponding to the phase reference sampling point number, and the first sampling point of the $m^{th}$ original frequency-lowered signal frame phase-matched to the sampling point corresponding to the phase reference sampling point number is configured to serve as the initial sampling point of the $m^{th}$ renovating frequency-lowered signal frame.

Conversely, if the first count value of the $(m-1)^{th}$ original frequency-lowered signal frame corresponding to the sampling point corresponding to the phase reference sampling point number is not less than or equal to the second count value of the $(m-1)^{th}$ original frequency-lowered signal frame corresponding to the sampling point corresponding to the phase reference sampling point number (i.e., formula (17) is not satisfied), the processing unit 102 uses the second count value of the $(m-1)^{th}$ original frequency-lowered signal frame corresponding to the sampling point corresponding to the phase reference sampling point number as the reference value, and uses a very-first-sampled sampling point among the sampling points of the $m^{th}$ original frequency-lowered signal frame corresponding to the second count value being equal to the reference value as the first sampling point. Aforesaid operations may be represented by the following formulas (20) and (21):

$$n_{Cot_m}^{-}(n) = \begin{cases} n, & Cot_m^{-}(n) = Cot_{m-1}^{-}S \\ 4N-4, & \text{else} \end{cases} \tag{20}$$

$$n_{Cot_m} = \min\{n_{Cot_m}^{-}(n)\} \tag{21}$$

In view of formulas (20) and (21), it can be known that, when the second count value of the $m^{th}$ original frequency-lowered signal frame corresponding to the sampling point of the number n is equal to the second count value of the $(m-1)^{th}$ original frequency-lowered signal frame corresponding to the sampling point corresponding to the phase reference sampling point number, $n_{Cot_m}^{-}(n)$ is equal to the number n corresponding to the sampling point; otherwise, $n_{Cot_m}^{-}(n)$ is equal to 4N−4. $n_{Cot_m}$ is a minimum value among all $n_{Cot_m}^{-}(n)$, which represents the number of the first sampling point of the $m^{th}$ original frequency-lowered signal frame phase-matched to the sampling point corresponding to the phase reference sampling point number, and the sampling point is configured to serve as the initial sampling point of the $m^{th}$ renovating frequency-lowered signal frame.

For instance, it is assumed that each of the original frequency-lowered signal frames WL1 to WL4 in FIG. 2 includes 401 sampling points, that is, each of the original frequency-lowered signal frames WL1 to WL4 includes 401 sampling points starting from 0, 1, 2, . . . , to 400. A first count value $Cot_2^{+}(188)$ of the original frequency-lowered signal frame WL2 corresponding to the middle sampling point of the renovating frequency-lowered signal frame WL2' corresponding to the phase reference sampling point number (which is 188) is less than or equal to a second count value $Cot_2^{-}(188)$ of the original frequency-lowered signal frame WL2 corresponding to the middle sampling point of the renovating frequency-lowered signal frame WL2' corresponding to the phase reference sampling point number, and the first count value $Cot_2^{+}(188)$ corresponding to the middle sampling point of the original frequency-lowered signal frame WL2 (i.e., the sampling point of the number being 188 in the original frequency-lowered signal frame WL2) is 18.

Figure 4:
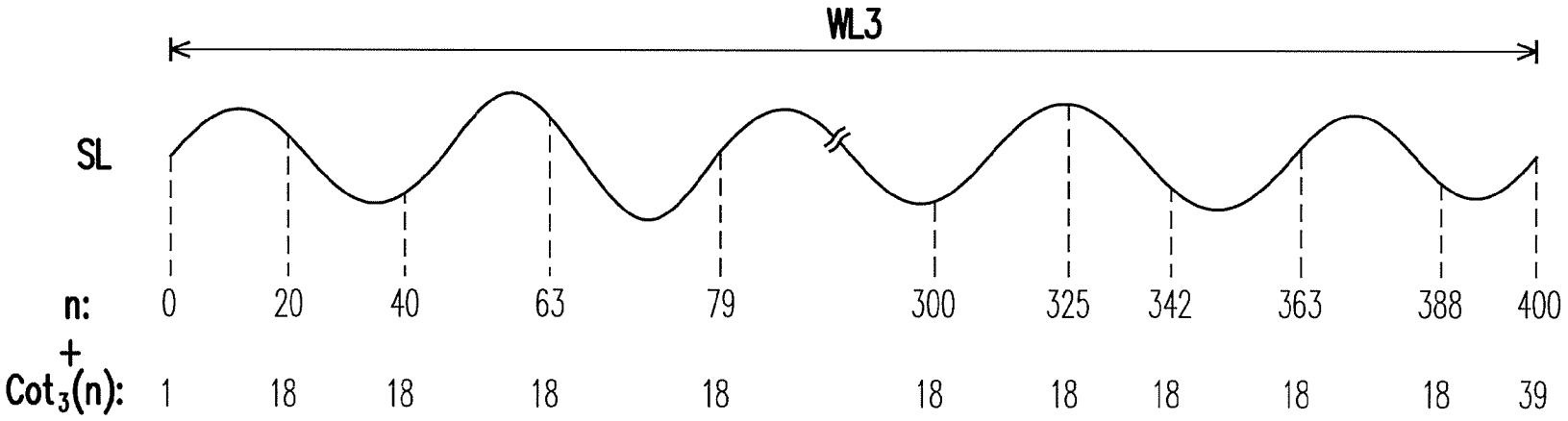
FIG. 4 is a schematic diagram illustrating the frequency-lowered signal frame WL3 according to an embodiment of the invention.

In order to locate an initial sampling point of the renovating frequency-lowered signal frame WL3', the processing unit 102 may count the first count value $Cot_3^{+}(n)$ of the original frequency-lowered signal frame WL3, so as to obtain the numbers of the sampling points whose first count values $Cot_3^{+}(n)$ are equal to 18 (because the first count value $Cot_2^{+}(188)$ of the original frequency-lowered signal frame WL2 corresponding to the sampling point of the number being 188 is less than the corresponding second count value $Cot_2^{-}(188)$, the first count value $Cot_2^{+}(188)$ is used as the reference value). As shown by the schematic diagram illustrating the frequency-lowered signal frame WL3 in FIG. 4, in the embodiment of FIG. 4, the number of the sampling points where the first count value $Cot_3^{+}(n)$ of the original frequency-lowered signal frame WL3 is equal to 18 (i.e., the value of $n_{Cot_3}^{+}(n)$ that is not equal to 0) includes the numbers 20, 40, 63, 79, . . . , 300, 325, 342, 363, 388. Herein, because the sampling point of the number 20 is corresponding to a very-first-sampled sampling point among the sampling points of the original frequency-lowered signal frame WL3 where the first count value $Cot_3^{+}(n)$ is equal to the reference value of the original frequency-lowered signal frame WL2 (the value thereof is 18), $n_{Cot_3}$ is equal to 20, such that the processing unit 102 may use 20 as the initial sampling point of the renovating frequency-lowered signal frame WL3', and use 201 consecutive sampling points starting from the sampling point of the number 20 of the original frequency-lowered signal frame WL3 as the sampling points of the renovating frequency-lowered signal frame WL3'. A shown in FIG. 2, the renovating frequency-lowered signal frame WL3' includes the sampling points starting from the number 20 to the number 220 of the original frequency-lowered signal frame WL3. Herein, the number 120 (which is the number of the sampling point of the original frequency-lowered signal frame WL3 corresponding to the middle sampling point of the renovating frequency-lowered signal frame WL3') may be used as the phase reference sampling point number, which is used as a reference for searching an initial sampling point of the renovating frequency-lowered signal frame WL4'. Similarly, the initial sampling point of the renovating frequency-lowered signal frame WL4' may also be obtained by the same method, which is not repeated hereinafter.

It should be noted that, because the original frequency-lowered signal frame WL1 is the first original frequency-lowered signal frame, the sampling points of the renovating frequency-lowered signal frame WL1' may be any 201 consecutive sampling points selected from the original frequency-lowered signal frame WL1 (e.g., the sampling points starting from the number 100 to the number 300 in the present embodiment), and the number of the sampling point of the original frequency-lowered signal frame WL1 corresponding to the middle sampling point of the renovating frequency-lowered signal frame WL1' may be used as the phase reference sampling point number (e.g., the sampling point of the number 200 in the present embodiment). In the present embodiment, the number of the first sampling point of the original frequency-lowered signal frame WL2 phase-matched to the middle sampling point of the original frequency-lowered signal frame WL1 is 188. Herein, a method for obtaining the first sampling point (the sampling point of the number 188) is similar to that used in foregoing embodiment, and person skilled in the art should be able to infer its implementation based on teachings in the foregoing embodiment, which are not repeated hereinafter.

After obtaining the renovating frequency-lowered signal frames, the processing unit 102 may then perform the 50% overlapping operation on the adjacent renovating frequency-lowered signal frames to generate an overlapped voice signal. Because the middle sampling point of each of the renovating frequency-lowered signal frames is phase-matched to the initial sampling point of the next renovating frequency-lowered signal frame, the issue of the signal distortion caused by the phase mismatching condition occurred when the signal frames are overlapped may be substantially solved. Furthermore, in some embodiments, after the renovating frequency-lowered signal frames corresponding to the original frequency-lowered signal frames are obtained, the frequency-lowered signal may be multiplied by a Hamming window to improve a continuity between the right-end and the left-end of the frequency-lowered signal. As shown by FIG. 2, after a frequency-lowered signal SL' including the renovating frequency-lowered signal frames WL1' to WL4' is multiplied by the Hamming window, a frequency-lowered signal SH including renovating frequency-lowered signal frames WH1 to WH4 may be obtained, and an overlapped voice signal SO may be obtained by overlapping the renovating frequency-lowered signal frames WH1 to WH4.

Figure 5:
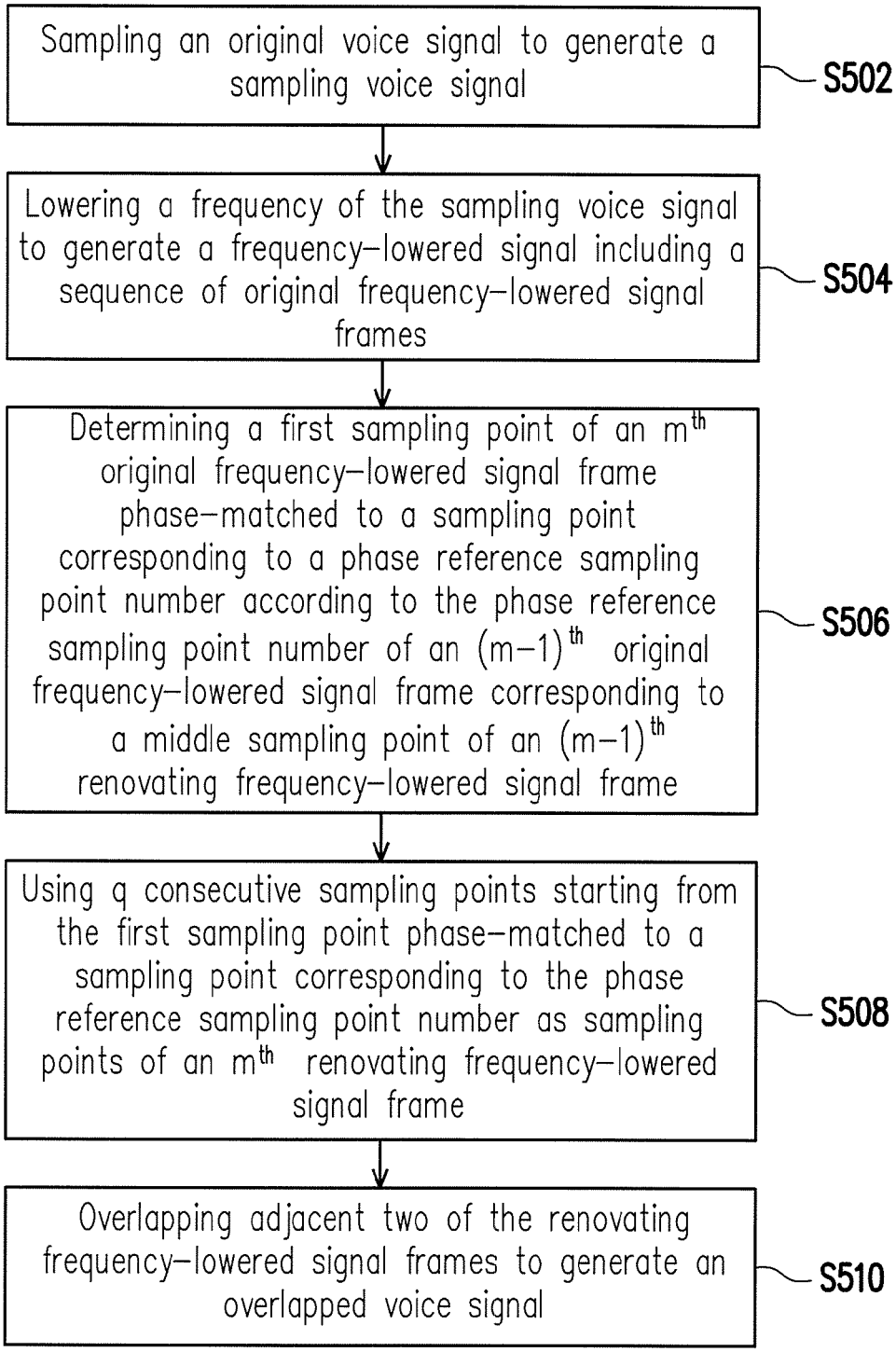
FIG. 5 is a schematic flowchart illustrating a voice signal processing method according to an embodiment of the invention.
Figure 6:
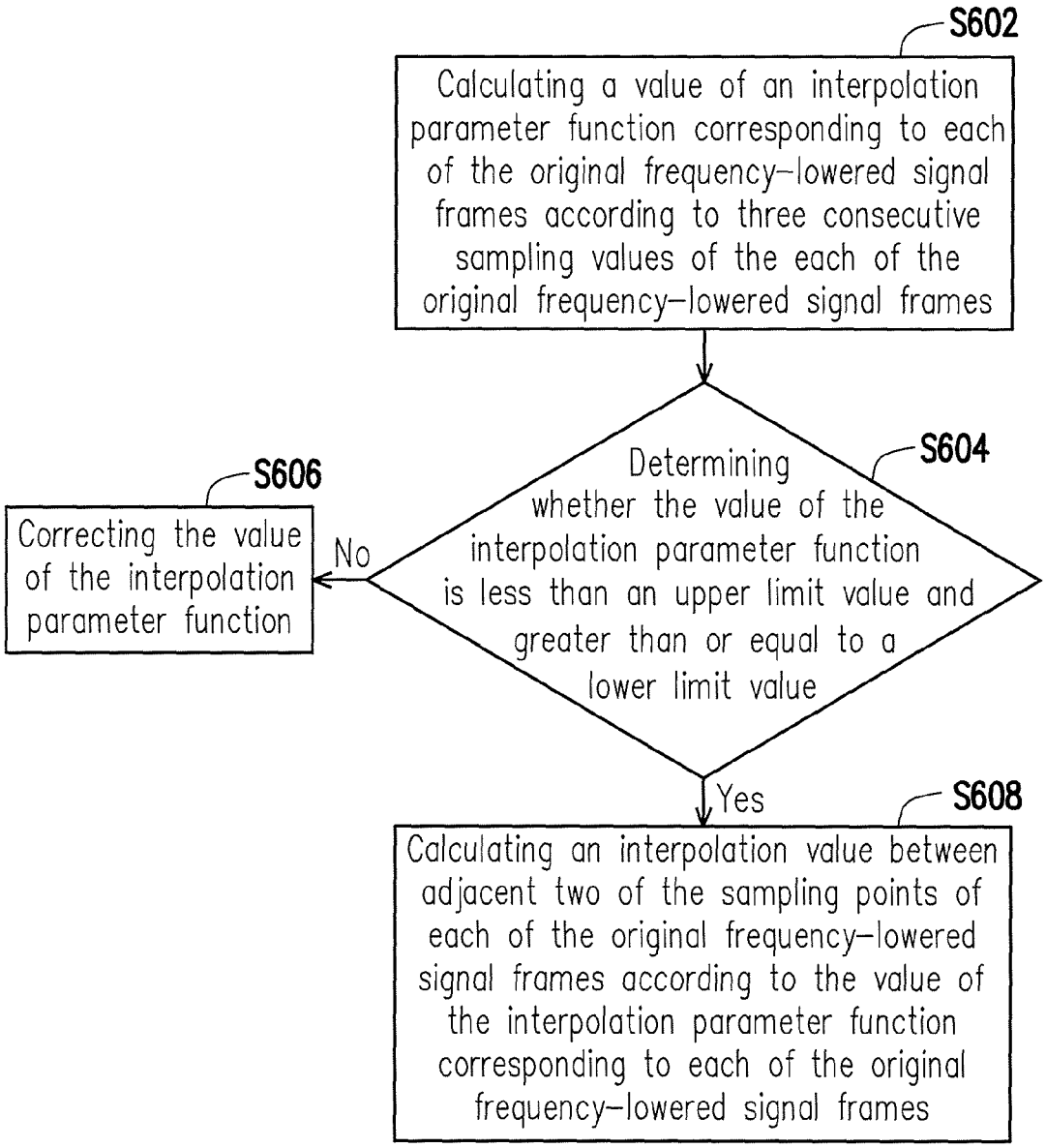
FIG. 6 is a schematic flowchart illustrating a voice signal processing method according to another embodiment of the invention.

Referring to FIG. 5, FIG. 5 is a schematic diagram illustrating a voice signal processing method according to an embodiment of the invention. In view of the foregoing embodiments, a voice signal processing method of said voice signal processing apparatus may include the following steps. First of all, an original voice signal is sampled to generate a sampling voice signal (step S502). Next, a frequency of the sampling voice signal is lowered to generate a frequency-lowered signal including a sequence of original frequency-lowered signal frames (step S504), wherein the frequency of the frequency-lowered signal may be, for example, one fourth of the frequency of the sampling voice signal. Herein, a part of sampling points in the frequency-lowered signal may be obtained by the interpolation. As shown by FIG. 6, in view of the foregoing embodiments, it can be known that, the method for calculating the interpolation point by the voice signal processing apparatus may include the following steps. First, a value of an interpolation parameter function corresponding to each of the original frequency-lowered signal frames is calculated according to three consecutive sampling values of each of the original frequency-lowered signal frames (step S602), wherein the interpolation parameter function may be obtained by calculating a trigonometric function relationship of the three consecutive sampling values of each of the original frequency-lowered signal frames, and the interpolation parameter function may be a trigonometric function. Thereafter, whether the value of the interpolation parameter function is less than an upper limit value and greater than or equal to a lower limit value is determined (step S604). If the value of the interpolation parameter function is not less than the upper limit value or is not greater than or equal to the lower limit value, the value of the interpolation parameter function is corrected (step S606), so as to remove unnecessary noises. Herein, the upper limit value and the lower limit value may be adjusted depending on actual condition in the noise interference. For example, the upper limit value and the lower limit value may be adjusted according to a frequency of the original voice signal and a sampling frequency of the sampling unit. The correction of the value of the interpolation parameter function may, for example, include: if the value of the interpolation parameter function is greater than or equal to the upper limit value, the value of the interpolation parameter function is corrected to be the upper limit value; and if the value of the interpolation parameter function is less than the lower limit value, the value of the interpolation parameter function is corrected to be the lower limit value. After, the value of the interpolation parameter function is corrected, an interpolation value between adjacent two of the sampling points of each of the original frequency-lowered signal frames may be calculated according to the value of the interpolation parameter function corresponding to each of the original frequency-lowered signal frames (step S608). Conversely, if the value of the interpolation parameter function is less than the upper limit value and greater than or equal to the lower limit value, the flow directly proceeds to step S608, in which the interpolation value between the adjacent two of the sampling points of each of the original frequency-lowered signal frames is calculated.

Referring back to FIG. 5, after step S504, a first sampling point of an $m^{th}$ original frequency-lowered signal frame phase-matched to the sampling point corresponding to a phase reference sampling point number is determined according to the phase reference sampling point number of an $(m-1)^{th}$ original frequency-lowered signal frame corresponding to a middle sampling point of an $(m-1)^{th}$ renovating frequency-lowered signal frame (step S506). Herein, a length of each of the renovating frequency-lowered signal frames is equal to one half a length of each of the original frequency-lowered signal frames, the phase reference sampling point number is a number of a sampling point of the $(m-1)^{th}$ original frequency-lowered signal frame corresponding to the middle sampling point of the $(m-1)^{th}$ renovating frequency-lowered signal frame, and m is a positive integer greater than 1. Thereafter, q consecutive sampling points starting from the first sampling point phase-matched to a sampling point corresponding to the phase reference sampling point number are used as sampling points of an $m^{th}$ renovating frequency-lowered signal frame (step S508), wherein q is a positive integer. Lastly, adjacent two of the renovating frequency-lowered signal frames are overlapped to generate an overlapped voice signal (step S510), wherein each of the adjacent two of the renovating frequency-lowered signal frames, for example, include a 50% overlapping section.

Figure 7:
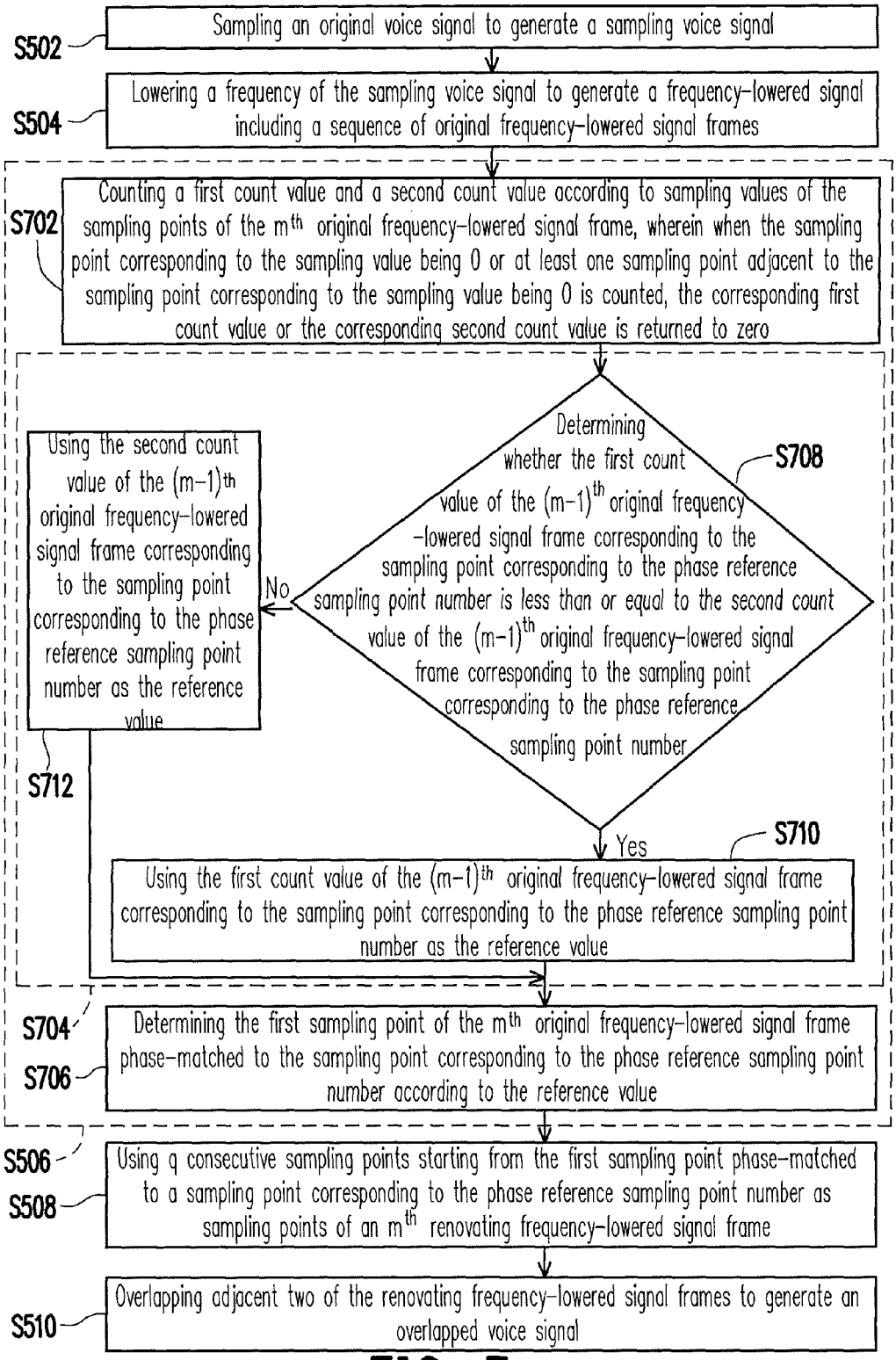
FIG. 7 is a schematic flowchart illustrating a voice signal processing method according to another embodiment of the invention.

Referring to FIG. 7, FIG. 7 is a schematic diagram illustrating a voice signal processing method according to another embodiment of the invention. Specifically, in the present embodiment, step S506 of FIG. 5 may include steps S702 to S706. That is, a first count value and a second count value are counted according to sampling values of the sampling points of the $m^{th}$ original frequency-lowered signal frame, wherein when the sampling point corresponding to the sampling value being 0 or a sampling point adjacent to the sampling point corresponding to the sampling value being 0 is counted, the corresponding first count value or the corresponding second count value is returned to zero (step S702). Then, the first count value or the second count value of the $m^{th}$ original frequency-lowered signal frame corresponding to the sampling point corresponding to the phase reference sampling point number is used as a reference value (step S704). Thereafter, the first sampling point of the $m^{th}$ original frequency-lowered signal frame phase-matched to the sampling point corresponding to the phase reference sampling point number is determined according to the reference value (step S706). To be more specifically, step S704 may include: determining whether the first count value of the $(m-1)^{th}$ original frequency-lowered signal frame corresponding to the sampling point corresponding to the phase reference sampling point number is less than or equal to the second count value of the $(m-1)^{th}$ original frequency-lowered signal frame corresponding to the sampling point corresponding to the phase reference sampling point number (step S708). If the first count value of the $(m-1)^{th}$ original frequency-lowered signal frame corresponding to the sampling point corresponding to the phase reference sampling point number is less than or equal to the second count value of the $(m-1)^{th}$ original frequency-lowered signal frame corresponding to the sampling point corresponding to the phase reference sampling point number, the first count value of the $(m-1)^{th}$ original frequency-lowered signal frame corresponding to the sampling point corresponding to the phase reference sampling point number is used as the reference value (step S710). In this case, a very-first-sampled sampling point among the sampling points of the $m^{th}$ original frequency-lowered signal frame where the first count value is equal to the reference value may be used as the first sampling point of the $m^{th}$ original frequency-lowered signal frame phase-matched to the sampling point corresponding to the phase reference sampling point number in step S706. Conversely, if the first count value of the $(m-1)^{th}$ original frequency-lowered signal frame corresponding to the sampling point corresponding to the phase reference sampling point number is not less than or equal to the second count value of the $(m-1)^{th}$ original frequency-lowered signal frame corresponding to the sampling point corresponding to the phase reference sampling point number, the second count value of the $(m-1)^{th}$ original frequency-lowered signal frame corresponding to the sampling point corresponding to the phase reference sampling point number is used as the reference value (step S712). In this case, a very-first-sampled sampling point among the sampling points of the $m^{th}$ original frequency-lowered signal frame where the second count value is equal to the reference value may be used as the first sampling point of the $m^{th}$ original frequency-lowered signal frame phase-matched to the sampling point corresponding to the phase reference sampling point number in step S706.

In summary, according to the embodiments of the invention, a first sampling point of an $m^{th}$ original frequency-lowered signal frame phase-matched to the sampling point corresponding to a phase reference sampling point number is determined according to the phase reference sampling point number of an $(m-1)^{th}$ original frequency-lowered signal frame corresponding to a middle sampling point of an $(m-1)^{th}$ renovating frequency-lowered signal frame, and q consecutive sampling points starting from the first sampling point phase-matched to the sampling point corresponding to the phase reference sampling point number are used as the sampling points of an $m^{th}$ renovating frequency-lowered signal frame. As a result, when the frequency of the sampling voice signal is further lowered (e.g., when the frequency is to be lowered to be one fourth), the issue of the signal distortion caused by the phase mismatching condition occurred when the signal frames are overlapped may still be effectively solved.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A voice signal processing apparatus, comprising:

a central processing unit, configured to lower a sampling voice signal to generate a frequency-lowered signal including a sequence of original frequency-lowered signal frames, and generate corresponding renovating frequency-lowered signal frames according to the original frequency-lowered signal frames, wherein each of the original frequency-lowered signal frames comprises p sampling points, the central processing unit determines a first sampling point of an $m^{th}$ original frequency-lowered signal frame phase-matched to the sampling point corresponding to a phase reference sampling point number according to the phase reference sampling point number of an $(m-1)^{th}$ original frequency-lowered signal frame corresponding to a middle sampling point of an $(m-1)^{th}$ renovating frequency-lowered signal frame, uses q consecutive sampling points starting from the first sampling point phase-matched to the sampling point corresponding to the phase reference sampling point number as the sampling points of an $m^{th}$ renovating frequency-lowered signal frame, overlaps adjacent two of the renovating frequency-lowered signal frames to generate an overlapped voice signal, wherein the phase reference sampling point number is a number of the sampling point of the $(m-1)^{th}$ original frequency-lowered signal frame corresponding to the middle sampling point of the $(m-1)^{th}$ renovating frequency-lowered signal frame, p and q are positive integers, and m is a positive integer greater than 1.

2. The voice signal processing apparatus of claim 1, wherein a frequency of the frequency-lowered signal is one fourth the frequency of the sampling voice signal, and a length of each of the renovating frequency-lowered signal frames is equal to one half a length of each of the original frequency-lowered signal frames.

3. The voice signal processing apparatus of claim 1, wherein each of the adjacent two of the renovating frequency-lowered signal frames includes a 50% overlapping section.

4. The voice signal processing apparatus of claim 3, wherein the central processing unit further counts a first count value and a second count value according to sampling values of the sampling points of the $m^{th}$ original frequency-lowered signal frame, wherein when the sampling point corresponding to the sampling value being 0 or a sampling point adjacent to the sampling point corresponding to the sampling value being 0 is counted, the central processing unit returns the corresponding first count value or the corresponding second count value to zero, uses the first count value or the second count value of the $m^{th}$ original frequency-lowered signal frame corresponding to the sampling point corresponding to the phase reference sampling point number as a reference value, and determines the first sampling point of the $m^{th}$ original frequency-lowered signal frame phase-matched to the sampling point corresponding to the phase reference sampling point number according to the reference value.

5. The voice signal processing apparatus of claim 4, wherein the central processing unit further determine whether the first count value of the $(m-1)^{th}$ original frequency-lowered signal frame corresponding to the sampling point corresponding to the phase reference sampling point number is less than or equal to the second count value of the $(m-1)^{th}$ original frequency-lowered signal frame corresponding to the sampling point corresponding to the phase reference sampling point number; if the first count value of the $(m-1)^{th}$ original frequency-lowered signal frame corresponding to the sampling point corresponding to the phase reference sampling point number is less than or equal to the second count value of the $(m-1)^{th}$ original frequency-lowered signal frame corresponding to the sampling point corresponding to the phase reference sampling point number, the central processing unit uses the first count value of the $(m-1)^{th}$ original frequency-lowered signal frame corresponding to the sampling point corresponding to the phase reference sampling point number as the reference value, and uses a very-first-sampled sampling point among the sampling points of the $m^{th}$ original frequency-lowered signal frame where the first count value is equal to the reference value as the first sampling point of the $m^{th}$ original frequency-lowered signal frame phase-matched to the sampling point corresponding to the phase reference sampling point number; and if the first count value of the $(m-1)^{th}$ original frequency-lowered signal frame corresponding to the sampling point corresponding to the phase reference sampling point number is not less than or equal to the second count value of the $(m-1)^{th}$ original frequency-lowered signal frame corresponding to the sampling point corresponding to the phase reference sampling point number, the central processing unit uses the second count value of the $(m-1)^{th}$ original frequency-lowered signal frame corresponding to the sampling point corresponding to the phase reference sampling point number as the reference value, and uses a very-first-sampled sampling point among the sampling points of the $m^{th}$ original frequency-lowered signal frame where the second count value is equal to the reference value as the first sampling point of the $m^{th}$ original frequency-lowered signal frame phase-matched to the sampling point corresponding to the phase reference sampling point number.

6. The voice signal processing apparatus of claim 1, wherein the central processing unit further multiplies the frequency-lowered signal by a Hamming window.

7. The voice signal processing apparatus of claim 1, wherein the central processing unit further calculates a value of an interpolation parameter function corresponding to each of the original frequency-lowered signal frames according to three consecutive sampling values of each of the original frequency-lowered signal frames, and calculates an interpolation value between adjacent two of the sampling points of each of the original frequency-lowered signal frames according to the value of the interpolation parameter function corresponding to each of the original frequency-lowered signal frames.

8. The voice signal processing apparatus of claim 7, wherein the central processing unit further determines whether the value of the interpolation parameter function is less than an upper limit value and greater than or equal to a lower limit value, and if the value of the interpolation parameter function is not less than the upper limit value or not greater than or equal to the lower range value, the central processing unit corrects the value of the interpolation parameter function, wherein if the value of the interpolation parameter function is greater than or equal to the upper limit value, the central processing unit corrects the value of the interpolation parameter function to be the upper limit value, and if the value of the interpolation parameter function is less than the lower limit value, the central processing unit corrects the value of the interpolation parameter function to be the lower value.

9. The voice signal processing apparatus of claim 8, wherein the sampling voice signal is generated by sampling an original voice signal, and the upper limit value and the lower limit value are associated with a frequency of the original voice signal and a sampling frequency for sampling the original voice signal.

10. The voice signal processing apparatus of claim 7, wherein the central processing unit further calculates the interpolation parameter function corresponding to each of the original frequency-lowered signal frames according to a trigonometric function relationship of the three consecutive sampling values of each of the original frequency-lowered signal frames, wherein the interpolation parameter function is a trigonometric function.

11. A voice signal processing method, further comprising:

lowering a frequency of a sampling voice signal to generate a frequency-lowered signal including a sequence of original frequency-lowered signal frames, wherein each of the original frequency-lowered signal frames comprises p sampling points, wherein p is a positive integer;

determining a first sampling point of an $m^{th}$ original frequency-lowered signal frame phase-matched to the sampling point corresponding to a phase reference sampling point number according to the phase reference sampling point number of an $(m-1)^{th}$ original frequency-lowered signal frame corresponding to a middle sampling point of an $(m-1)^{th}$ renovating frequency-lowered signal frame, wherein m is a positive integer greater than 1, and the phase reference sampling point number is a number of the sampling point of the $(m-1)^{th}$ original frequency-lowered signal frame corresponding to the middle sampling point of the $(m-1)^{th}$ renovating frequency-lowered signal frame; and using q consecutive sampling points starting from the first sampling point phase-matched to the sampling point corresponding to the phase reference sampling point number as the sampling points of an mth renovating frequency-lowered signal frame, wherein q is a positive integer; and overlapping adjacent two of the renovating frequency-lowered signal frames to generate an overlapped voice signal.

12. The voice signal processing method of claim 11, wherein a frequency of the frequency-lowered signal is one fourth the frequency of the sampling voice signal, and a length of each of the renovating frequency-lowered signal frames is equal to one half a length of each of the original frequency-lowered signal frames.

13. The voice signal processing method of claim 11, wherein each of the adjacent two of the renovating frequency-lowered signal frames includes a 50% overlapping section.

14. The voice signal processing method of claim 13, wherein the step of determining the first sampling point of the $m^{th}$ original frequency-lowered signal frame phase-matched to the sampling point corresponding to the phase reference sampling point number according to the phase reference sampling point number of the $(m-1)^{th}$ original frequency-lowered signal frame corresponding to the middle sampling point of the $(m-1)^{th}$ renovating frequency-lowered signal frame comprises:

counting a first count value and a second count value according to sampling values of the sampling points of the $m^{th}$ original frequency-lowered signal frame, wherein when the sampling point corresponding to the sampling value being 0 or a sampling point adjacent to the sampling point corresponding to the sampling value being 0 is counted, the corresponding first count value or the corresponding second count value is returned to zero;

using the first count value or the second count value of the $m^{th}$ original frequency-lowered signal frame corresponding to the sampling point corresponding to the phase reference sampling point number as a reference value; and determining the first sampling point of the $m^{th}$ original frequency-lowered signal frame phase-matched to the sampling point corresponding to the phase reference sampling point number according to the reference value.

15. The voice signal processing method of claim 14, wherein the step of using the first count value or the second count value of the $m^{th}$ original frequency-lowered signal frame corresponding to the sampling point corresponding to the phase reference sampling point number as the reference value comprises:

determining whether the first count value of the $(m-1)^{th}$ original frequency-lowered signal frame corresponding to the sampling point corresponding to the phase reference sampling point number is less than or equal to the second count value of the $(m-1)^{th}$ original frequency-lowered signal frame corresponding to the sampling point corresponding to the phase reference sampling point number;

if the first count value of the $(m-1)^{th}$) original frequency-lowered signal frame corresponding to the sampling point corresponding to the phase reference sampling point number is less than or equal to the second count value of the $(m-1)^{th}$ original frequency-lowered signal frame corresponding to the sampling point corresponding to the phase reference sampling point number, using the first count value of the $(m-1)^{th}$ original frequency-lowered signal frame corresponding to the sampling point corresponding to the phase reference sampling point number as the reference value; and if the first count value of the $(m-1)^{th}$ original frequency-lowered signal frame corresponding to the sampling point corresponding to the phase reference sampling point number is not less than or equal to the second count value of the $(m-1)^{th}$ original frequency-lowered signal frame corresponding to the sampling point corresponding to the phase reference sampling point number, using the second count value of the $(m-1)^{th}$ original frequency-lowered signal frame corresponding to the sampling point corresponding to the phase reference sampling point number as the reference value.

16. The voice signal processing method of claim 15, wherein if the first count value of the $(m-1)^{th}$ original frequency-lowered signal frame corresponding to the sampling point corresponding to the phase reference sampling point number is less than or equal to the second count value of the $(m-1)^{th}$ original frequency-lowered signal frame corresponding to the sampling point corresponding to the phase reference sampling point number, the voice signal processing method further comprises:

using a very-first-sampled sampling point among the sampling points of the $m^{th}$ original frequency-lowered signal frame where the first count value is equal to the reference value as the first sampling point of the $m^{th}$ original frequency-lowered signal frame phase-matched to the sampling point corresponding to the phase reference sampling point number.

17. The voice signal processing method of claim 15, wherein if the first count value of the $(m-1)^{th}$ original frequency-lowered signal frame corresponding to the sampling point corresponding to the phase reference sampling point number is not less than or equal to the second count value of the $(m-1)^{th}$ original frequency-lowered signal frame corresponding to the sampling point corresponding to the phase reference sampling point number, the voice signal processing method further comprises:

using a very-first-sampled sampling point among the sampling points of the $m^{th}$ original frequency-lowered signal frame where the second count value is equal to the reference value as the first sampling point of the $m^{th}$ original frequency-lowered signal frame phase-matched to the sampling point corresponding to the phase reference sampling point number.

18. The voice signal processing method of claim 11, comprising:

multiplying the frequency-lowered signal by a Hamming window.

19. The voice signal processing method of claim 11, comprising:

calculating a value of an interpolation parameter function corresponding to each of the original frequency-lowered signal frames according to three consecutive sampling values of each of the original frequency-lowered signal frames;

determining whether the value of the interpolation parameter function is less than an upper limit value and greater than or equal to a lower limit value, and if the value of the interpolation parameter function is not less than the upper limit value or not greater than or equal to the lower range value, correcting the value of the interpolation parameter function; and calculating an interpolation value between adjacent two of the sampling points of each of the original frequency-lowered signal frames according to the value of the interpolation parameter function corresponding to each of the original frequency-lowered signal frames.

20. The voice signal processing method of claim 19, wherein if the value of the interpolation parameter function is greater than or equal to the upper limit value, correcting the value of the interpolation parameter function to be the upper limit value, and if the value of the interpolation parameter function is less than the lower limit value, correcting the value of the interpolation parameter function to be the lower value, wherein the sampling voice signal is generated by sampling an original voice signal, and the upper limit value and the lower limit value are associated with a frequency of the original voice signal and a sampling frequency for sampling the original voice signal.

21. The voice signal processing method of claim 19, comprising:

calculating the interpolation parameter function corresponding to each of the original frequency-lowered signal frames according to a trigonometric function relationship of the three consecutive sampling values of each of the original frequency-lowered signal frames, wherein the interpolation parameter function is a trigonometric function.

* * * * *